US006877947B2

(12) United States Patent
Hellmann et al.

(10) Patent No.: US 6,877,947 B2
(45) Date of Patent: Apr. 12, 2005

(54) METHOD AND APPARATUS FOR EARLY FAULT DETECTION IN CENTRIFUGAL PUMPS

(75) Inventors: Heinz-Dieter Hellmann, Kaiserslautern (DE); Christian Trautmann, Enkenbach-Alsenborn (DE); Juergen Schill, Weisenheim/Berg (DE); Falk Schaefer, Kaiserslautern (DE)

(73) Assignee: KSB Aktiengesellschaft, Frankenthal (DE)

( * ) Notice: Subject to any disclaimer, the term of this patent is extended or adjusted under 35 U.S.C. 154(b) by 0 days.

(21) Appl. No.: 10/715,831

(22) Filed: Nov. 19, 2003

(65) Prior Publication Data

US 2004/0151581 A1 Aug. 5, 2004

(30) Foreign Application Priority Data

Nov. 20, 2002 (DE) ..... 102 54 041

(51) Int. Cl.[7] ..... F04D 29/00; F04D 29/04

(52) U.S. Cl. ..... 415/1; 415/118; 415/104; 73/168

(58) Field of Search ..... 415/1, 14, 26, 415/47, 13, 104, 107, 118; 417/365; 73/168

(56) References Cited

U.S. PATENT DOCUMENTS

| | | | | |
|---|---|---|---|---|
| 3,468,259 A | * | 9/1969 | Morzynski et al. | 415/175 |
| 4,578,018 A | * | 3/1986 | Pope | 415/104 |
| 4,884,942 A | | 12/1989 | Pennink | |
| 4,909,076 A | | 3/1990 | Busch et al. | |
| 5,277,543 A | | 1/1994 | Noguchi et al. | |
| 5,649,449 A | | 7/1997 | Algers | |
| 5,713,720 A | * | 2/1998 | Barhou | 415/104 |
| 6,568,901 B2 | | 5/2003 | Wang et al. | |

FOREIGN PATENT DOCUMENTS

| | | | | |
|---|---|---|---|---|
| DE | 886250 A | * | 8/1953 | 415/104 |
| DE | 3725754 | | 2/1989 | F04D/9/00 |
| DE | 4225783 | | 2/1993 | F04D/13/08 |
| DE | 19615923 | | 10/1996 | F04D/15/00 |
| JP | 55-87889 A | * | 7/1980 | 415/118 |
| WO | WO 00/77405 A1 | | 12/2000 | F04D/29/04 |

OTHER PUBLICATIONS

German Search Report, dated Jun. 3, 2003.

* cited by examiner

*Primary Examiner*—Christopher Verdier
(74) *Attorney, Agent, or Firm*—Crowell & Moring LLP

(57) ABSTRACT

A method and apparatus for early fault detection in a centrifugal pump equipped with a balancing device, where the balancing device has an axial gap and optionally at least one radial gap through which a balancing flow is conducted, and with a spring element which acts on the balancing device to hold open the axial gap. Reliable information regarding impending faults is obtained while largely using existing elements by measuring the deformation of the spring element (10, 14) during operation of the centrifugal pump (24), and starting from the pump characteristics of the centrifugal pump (24) and the spring constant of the spring element (10, 14), drawing a conclusion regarding the instantaneous operating state of the centrifugal pump based on the measured deformation.

11 Claims, 3 Drawing Sheets

METHOD AND APPARATUS FOR EARLY FAULT DETECTION IN CENTRIFUGAL PUMPS

BACKGROUND OF THE INVENTION

The present invention relates to a method and apparatus for early fault detection in a centrifugal pump that is equipped with a balancing device. The balancing device has an axial gap and optionally one or more radial gaps through which a balancing flow is conducted. Further, a spring element is provided, which acts upon the balancing device to hold open (i.e., oppose complete closure of) the axial gap.

For early fault detection in centrifugal pumps, sensors have thus far been used, which detect any abnormal vibrations, temperature rises, noises or other measurable quantities and forward this data to a monitoring unit. For this purpose, a plurality of such sensors has been arranged on the outside of the pump housing. Thus, there was no direct connection with the site of the fault's source. The signals acquired by the sensors were not always clear and unambiguous, such that false messages could not be excluded. In particular, there was a risk that such messages came late, i.e., after damage had already occurred.

A significant fault in the interior of a centrifugal pump occurs if bearings are worn or if a balancing device no longer works sufficiently. Such a fault can come about gradually. It may initially not produce any symptoms detectable on the outside of the centrifugal pump and may manifest itself only after significant damage has occurred and possibly only after the centrifugal pump has failed.

It is possible to detect axial forces with the aid of an axially contacting sensor, i.e., a so-called a load cell. For structural reasons, however, such a load cell cannot be used continuously over a long period of time.

SUMMARY OF THE INVENTION

The object of the invention is to provide a method and apparatus for early fault detection in centrifugal pumps of the initially described type, which produces reliable information on impending faults while largely using existing elements.

According to the invention, this object is attained by measuring the deformation of the spring element during operation of the centrifugal pump starting from the pump characteristics of the centrifugal pump and the spring constants of the spring element and by drawing a conclusion regarding the instantaneous operating state of the centrifugal pump.

In one advantageous embodiment of the invention, baseline measurements are taken for each centrifugal pump type to be monitored to achieve early fault detection and for the pumping medium, which baseline measurements relate the axial force, the balancing force and the pressure distribution within the impeller chamber to operating points on the characteristic curve of the centrifugal pump.

In accordance with another advantageous embodiment of the invention, a dynamic measurement is taken which detects the frequency spectra of the spring element in order to determine the frequency bands that are associated with the pumped flow and thus provide information regarding potential faults in the centrifugal pump.

In specific cases, particularly in a basic investigation of the axial forces acting on the shaft of a centrifugal pump, it may be advantageous to use a second spring element arranged in opposite direction to the first spring element, to examine and possibly measure an axial thrust in the direction of the delivery side of the centrifugal pump. Such an axial thrust can occur if there is an extreme overload which results in a thrust reversal.

A particularly advantageous apparatus for carrying out the method according to the invention is obtained if the spring element is a cardanic ring which is dimensioned in such a way that it is deformed by a residual axial force predetermined by the configuration of the balancing device to adjust a likewise predetermined axial gap. A balancing device equipped with these elements is disclosed in U.S. Pat. No. 6,568,901 (=WO 00/77405), the entire disclosure of which is incorporated herein by reference.

The use of the method according to the invention and the device using this method are particularly suitable to detect incipient bearing wear or improper hydraulic conditions such as impermissible cavitation conditions, and/or to avoid approaching contact between the rotor and the housing of the centrifugal pump.

The method and apparatus according to the invention use a minimum number of sensors. The direct coupling of the sensors to the balancing device enables very early and reliable fault detection. The elastic or spring-like behavior of the cardanic ring used in what is considered a particularly preferred embodiment also makes it possible to stabilize the dynamic behavior of the rotor of the centrifugal pump.

BRIEF DESCRIPTION OF THE DRAWINGS

The invention will be described in further detail hereinafter with reference to illustrative preferred embodiments shown in the accompanying drawings, in which.

DETAILED DESCRIPTION OF PREFERRED EMBODIMENTS

Figure 1:
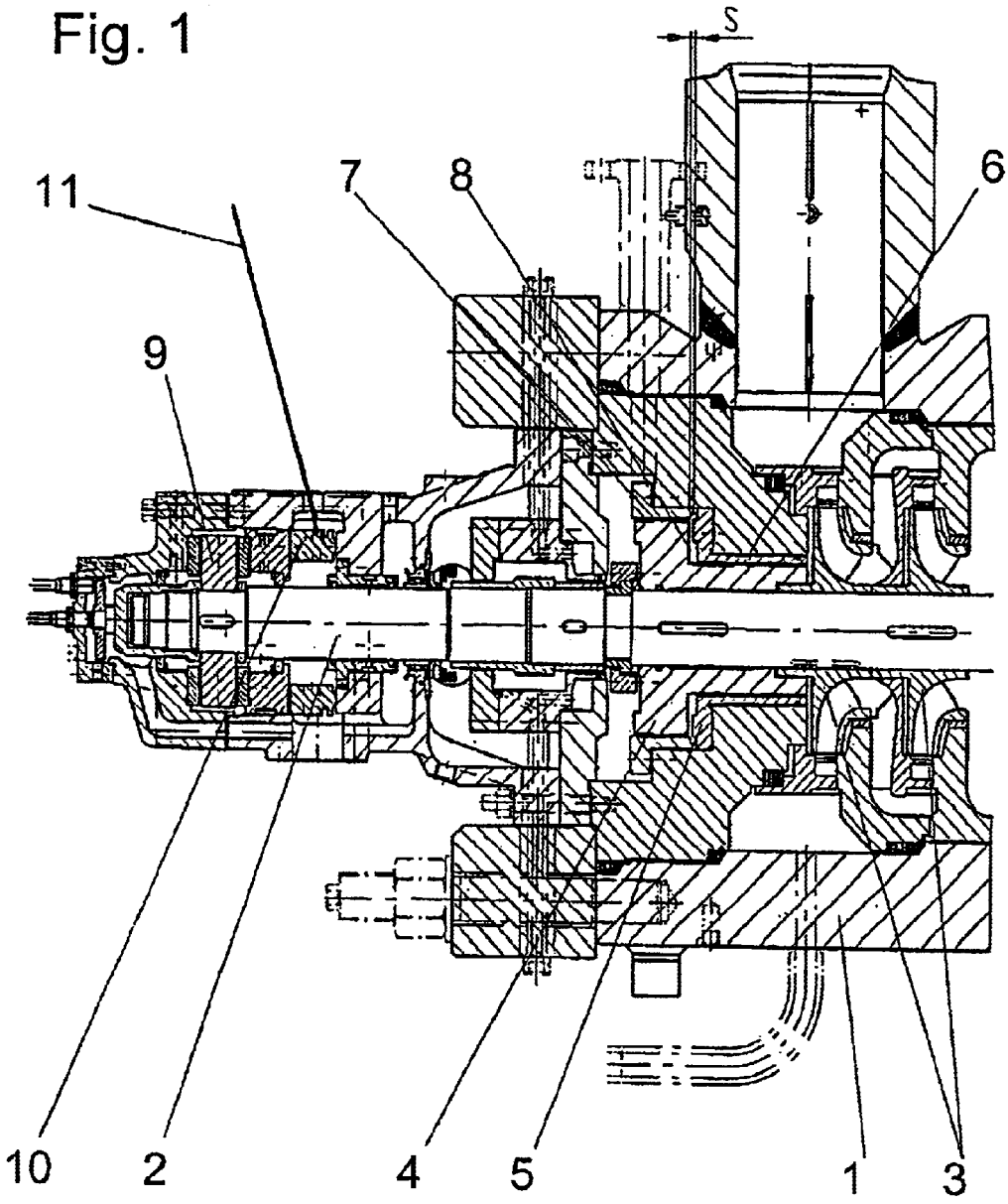
FIG. 1 is cross-sectional detail view of a multistage centrifugal pump having a cardanic ring arranged on the suction side of the bearing (i.e., the right side in the drawing), which serves to adjust a predefined axial gap in a balancing device and as an element of an axial force measuring device to carry out the method according to the invention.

As shown in FIG. 1, a shaft 2 carrying a plurality of impellers 3 is rotatably supported in the housing 1 of a centrifugal pump. The drawing shows only two of the impellers 3.

Also mounted on the shaft 2 is the dual piston 4 of a balancing device according to the invention. The dual piston 4 is surrounded by a housing part 5 with which it forms two radial gaps 6 and 7. Between the radial gaps 6 and 7 is an axial gap 8. The axial gap 8 has a variable width s.

On the delivery-side end of the centrifugal pump, the shaft 2 is supported in a hydrodynamic axial bearing 9. A cardanic ring 10 is associated with the axial bearing 9. The cardanic ring 10 serves first to offset alignment errors, which are unavoidable in the assembly of a multistage centrifugal pump. In addition, the cardanic ring 10 is dimensioned such that it is elastically deformed by and thus opposes the residual thrust in the centrifugal pump directed toward the suction side. The spring constant of the cardanic ring 10 is adapted to the other characteristics of the balancing device.

The balancing device is configured in such a way that a residual thrust acting in the direction of the suction side of the centrifugal pump exists in all operating conditions of the pump. Starting from a maximum width s of the axial gap 8 in the idle state of the centrifugal pump, under operating conditions the axial thrust toward the suction side of the pump deforms the cardanic ring 10 and closes the axial gap 8 to a predefined minimum width at which contact between the surfaces of the dual piston 4 defining the gap 8 and the housing part 5 is still avoided. The balancing device thereby has the advantage that the axial gap 8 has a self-regulating function.

Integrating the cardanic ring 10 in a suitable measuring device enables early detection of the forces that indicate improper hydraulic conditions such as impermissible cavitation conditions, or the onset of bearing wear. The deformation of the cardanic ring 10 that occurs during pump operation is detected or measured by suitable means, e.g., by a conventional strain gauge (not shown) and is transmitted as a signal to a signal processing device via a line 11. The direct mechanical coupling of the cardanic ring 10, which acts as an axial force sensor, to the measuring system makes it possible to measure signals without the attenuating influence of a fluid film, which in contactless sensors is always present between the sensor and the component.

Figure 2:
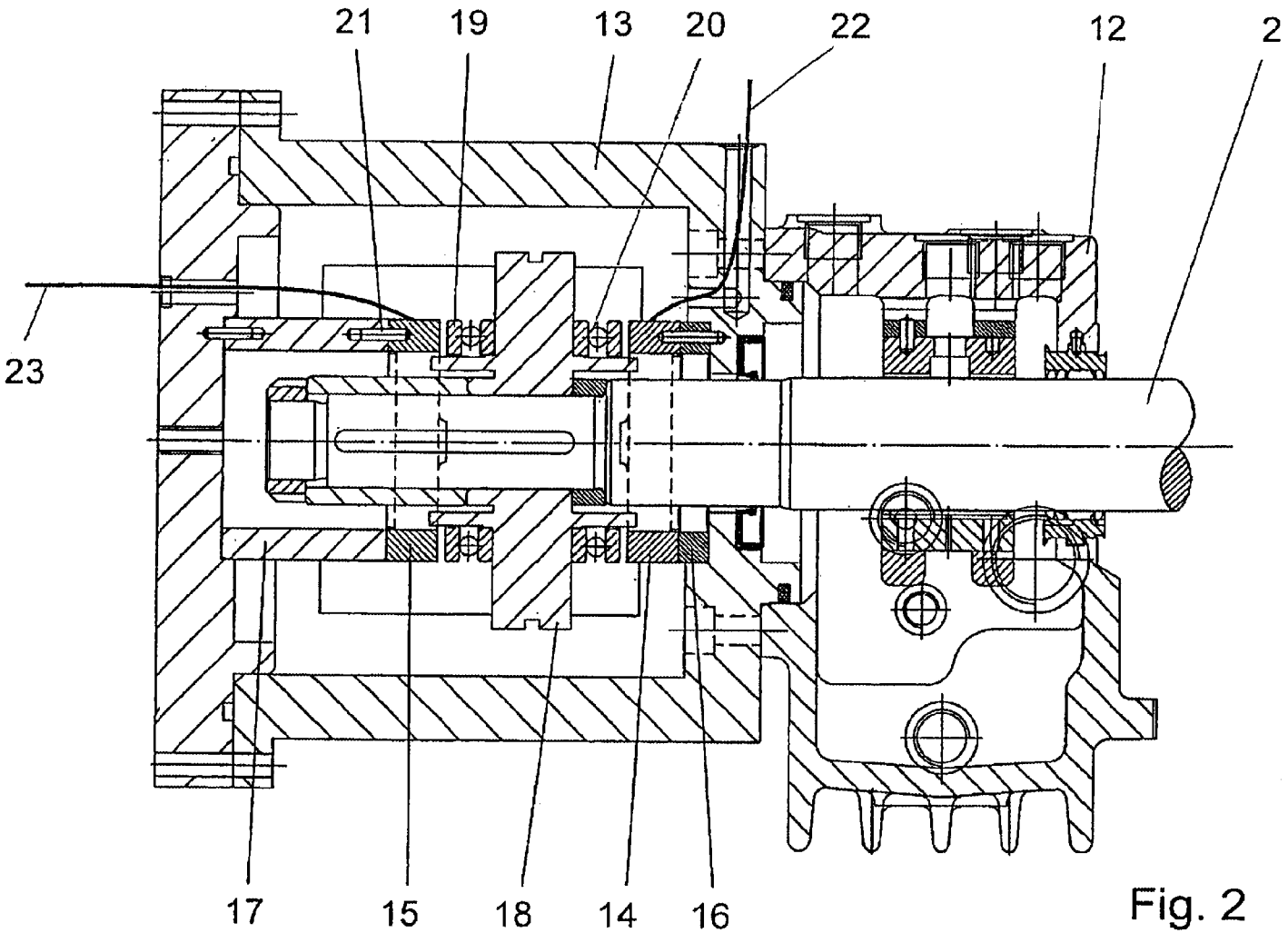
FIG. 2 is a detail of a centrifugal pump that essentially corresponds to the embodiment depicted in FIG. 1 and has a cardanic ring arranged on the suction side of the bearing and another on the delivery or pressure side of the bearing to create an axial force measuring device that acts in both thrust directions.

The axial force measuring device depicted in FIG. 2, like the device of FIG. 1, is mounted on the delivery-side bearing support 12 of a high-pressure ring-section pump. The individual components of the measuring device are accommodated in a cylindrical housing 13. The design of this embodiment calls for the use of two cardanic rings 14, 15, which makes it possible to measure axial forces in both directions of action. To stabilize the dynamic behavior of the rotor, the cardanic rings 14, 15 may be pre-stressed or biased. At the suction-side ring 14 this is done by means of a spacer ring 16 and at the delivery-side ring 15 by means of a spacer sleeve 17.

The force is introduced into the device starting from the pump rotor via an axial bearing plate 18, which is non-rotatably connected with the shaft 2. Depending on the direction of action of the axial thrust, the axial bearing plate 18 transmits the force to one of two axial deep groove ball bearings 19, 20, which are coupled directly to the cardanic rings 14, 15. The cardanic rings 14, 15 are subject to deflection and thus represent spring elements in a force-locked or friction driven chain. Uncompensated residual forces are transmitted to the housing via the spacer ring 16 or the spacer sleeve 17. The cardanic rings 14, 15 are each secured against rotation by a cylindrical pin 21. The deformation state is transmitted to a signal processing device via lines 22 and 23.

Figure 3:
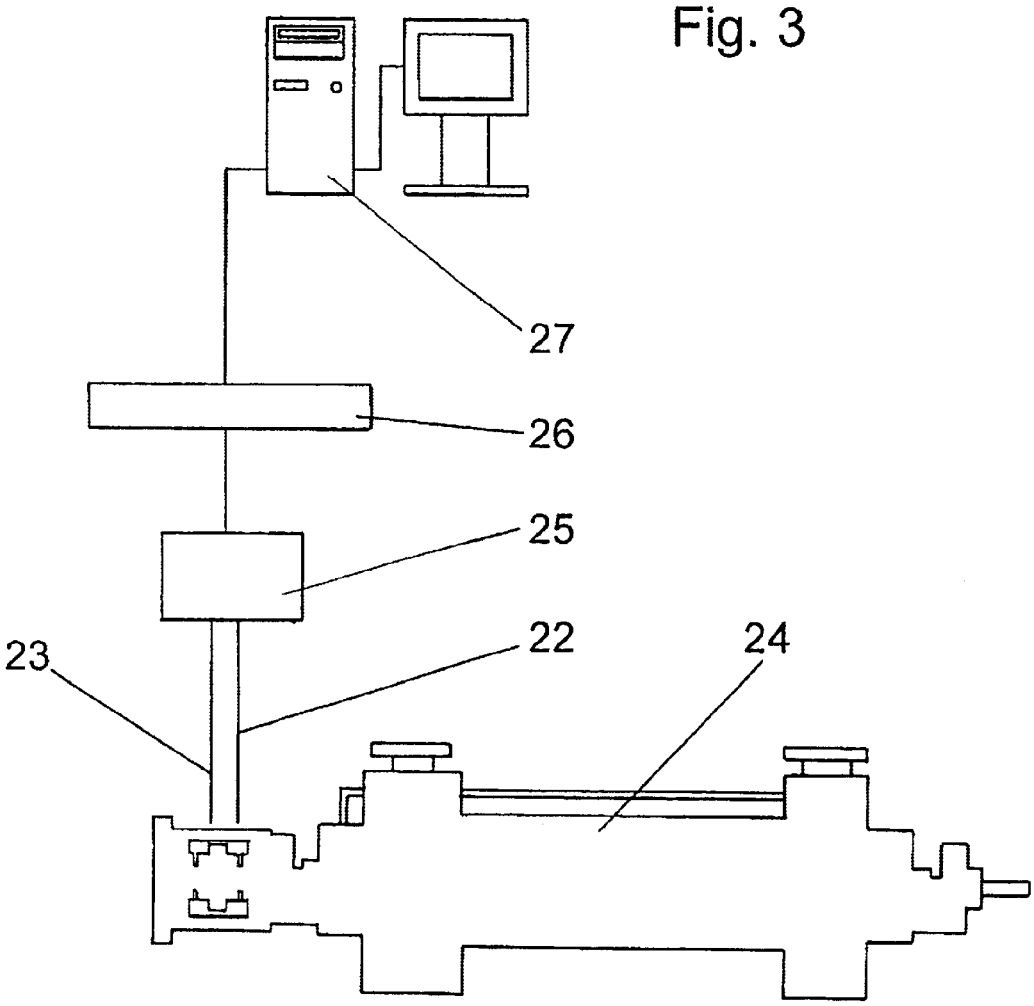
FIG. 3 is a schematic diagram of a centrifugal pump with a device for processing the signals detected by the axial force measuring device.

FIG. 3 schematically illustrates the signal processing of the measuring signals detected via the cardanic rings 14, 15 on a high-pressure ring-section pump 24. The first link of the axial force measuring chain is the cardanic rings 14, 15 to which strain gauges (DMS) (not shown) are applied. As described above, one ring 14 or 15 is provided for each load direction. Two full strain gauge bridges (not shown) whose input and output signals are connected in parallel are installed on each ring 14, 15. By being supplied with a constant voltage via a measuring amplifier and with identical characteristics of the strain gauges used in the bridges, the circuit forms the electrical average of the two bridge output signals. This compensates the uneven voltage distributions caused by possible eccentric force introduction into the rings.

The output signal is transmitted via a strain gauge amplifier 25 to a measuring transducer 26. This measuring transducer converts the signal into an output voltage of 0–10 V. Finally, the signal is transmitted to a measured data acquisition card of a computer 27 so that the measured data can be displayed and further processed.

The device depicted in FIG. 3 should be seen as an experimental setup. In practice, the elements used can be largely integrated into the centrifugal pump 24. Some of the elements can even be eliminated in practice, e.g., the ring 15 on the delivery side. Instead of two axial deep groove bearings 19, 20, it is also possible to use one hydrodynamic axial bearing.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. A method of early fault detection in a centrifugal pump equipped with a balancing device which comprises an axial gap through which a balancing flow is conducted, and with a balancing device spring element which is deformed by axial thrust of the pump and acts upon the balancing device to oppose complete closure of the axial gap; said method comprising measuring the deformation of the spring element during operation of the centrifugal pump, and starting from the pump characteristic curve of the centrifugal pump and the spring constant of the spring element, drawing a conclusion regarding the current operating state of the centrifugal pump based on the measured deformation.

2. A method according to claim 1, wherein said balancing device further comprises at least one radial gap.

3. A method according to claim 1, wherein baseline measurements are taken for each type of centrifugal pump which is to be monitored for early detection of pump faults and for the medium which is to be pumped; said baseline measurements relating the axial force, the balancing force and the pressure distribution within the impeller chamber to operating points on the characteristic curve of the centrifugal pump.

4. A method according to claim 1, wherein for each type of centrifugal pump which is to be monitored for early detection of faults and for the medium which is to be pumped, a dynamic measurement which determines the frequency spectra of the spring element is taken to detect frequency bands that are associated with the pumped flow and to indicate possible faults in the centrifugal pump.

5. A method according to claim 1, wherein axial thrust in the direction of the delivery side of the centrifugal pump is monitored or measured via a further spring element which is arranged in opposite direction to said balancing device spring element.

6. A method according to claim 1, wherein incipient bearing wear is detected.

7. A method according to claim 1, wherein approaching contact between a rotor and housing of the centrifugal pump is detected.

8. A method according to claim 1, wherein impermissible cavitation conditions are detected.

9. An apparatus for early detection of faults in a centrifugal pump equipped with a balancing device which comprises an axial gap through which a balancing flow is conducted and with a spring element which is deformed by an axial thrust of the pump and acts upon the balancing device to hold open the axial gap; said apparatus further comprising means for measuring the deformation of said spring element and correlating the measured deformation with the operating state of the pump.

10. An apparatus according to claim 9, wherein said spring element is a cardanic ring which is dimensioned such that it is deformed by a residual axial force defined by the configuration of the balancing device to adjust the axial gap to a prescribed value.

11. An apparatus according to claim 9, wherein said balancing device comprises at least one radial gap.

* * * * *